US007555925B1

(12) United States Patent
Wu

(10) Patent No.: US 7,555,925 B1
(45) Date of Patent: Jul. 7, 2009

(54) PADLOCK

(75) Inventor: Kun Yu Wu, Sinjhuang (TW)

(73) Assignee: Kun-Yu Wu, Taipei Hsien (TW)

( * ) Notice: Subject to any disclaimer, the term of this patent is extended or adjusted under 35 U.S.C. 154(b) by 0 days.

(21) Appl. No.: 12/228,817

(22) Filed: Aug. 15, 2008

(51) Int. Cl.
*E05B 67/22* (2006.01)

(52) U.S. Cl. ..... 70/31; 70/38 R; 70/38 B; 70/52; 70/53; 70/360; 70/491

(58) Field of Classification Search ..... 70/20, 70/21, 31, 35, 38 R, 38 A, 38 B, 38 C, 39, 70/52, 53, 360, 361, 491, 496
See application file for complete search history.

(56) References Cited

U.S. PATENT DOCUMENTS

| | | | | | |
|---|---|---|---|---|---|
| 208,123 | A * | 9/1878 | Roberts | 70/38 C |
| 459,499 | A * | 9/1891 | Moore | 70/38 R |
| 839,795 | A * | 12/1906 | Wilcox | 70/28 |
| 1,452,393 | A * | 4/1923 | Shek | 70/38 C |
| 1,477,777 | A * | 12/1923 | Shek | 70/38 C |
| 1,622,999 | A * | 3/1927 | Frith | 70/38 A |
| 2,116,965 | A * | 5/1938 | Schoorel et al. | 70/38 A |
| 4,838,051 | A * | 6/1989 | Yang | 70/38 A |
| 5,133,203 | A * | 7/1992 | Huang | 70/360 |
| 5,447,049 | A * | 9/1995 | Shieh | 70/360 |
| 5,720,191 | A * | 2/1998 | Tsung-Chuan et al. | 70/38 A |
| 6,523,378 | B2 * | 2/2003 | Kuo | 70/360 |
| 6,904,775 | B2 * | 6/2005 | Makos et al. | 70/16 |
| 7,171,833 | B1 * | 2/2007 | Wu | 70/491 |
| 7,370,892 | B2 * | 5/2008 | Collingham | 292/329 |
| 2006/0179899 | A1 * | 8/2006 | Yu | 70/21 |
| 2008/0223088 | A1 * | 9/2008 | Yang | 70/21 |
| 2008/0282753 | A1 * | 11/2008 | Hecht et al. | 70/35 |

* cited by examiner

*Primary Examiner*—Lloyd A Gall
(74) *Attorney, Agent, or Firm*—Law Offices of Khalilian Sira, LLC

(57) ABSTRACT

A padlock has a shell, a lock cylinder, a shackle and a resilient element. The lock cylinder is mounted in the shell and has a lock rod. The shackle is mounted slidably through a front opening of the shell and has a distal end, a proximal end and a protruding segment. The distal end is selectively received in a mounting slot of the shell. The protruding segment selectively abuts the lock rod to keep the shackle from sliding. The resilient element is mounted in the shell and presses against the proximal end of the shackle. With the resilient element, the distal end of the shackle is maintained in the mounting slot without any external force. Therefore, the padlock may still hold an object in position without locking and then the user may take the object easily without using a key.

12 Claims, 6 Drawing Sheets

PADLOCK

BACKGROUND OF THE INVENTION

1. Field of the Invention

The present invention relates to a padlock, especially to a padlock that keeps the object from being stolen and is small to be carried easily.

2. Description of the Prior Arts

Padlocks are widely used in daily life and are usually used to lock trunks, bicycles, etc. A conventional padlock comprises a shell, a U-shaped bolt and a lock cylinder. The bolt has a connecting end and a distal end. The connecting end of the bolt is mounted rotatably in the shell. The lock cylinder is mounted in the shell. When the lock cylinder is locked, the distal end of the bolt is held in the shell to lock the objects. When the lock cylinder is unlocked, the distal end of the bolt is pressed out of the shell to unlock the objects.

However, the conventional padlock only allows hooking two objects together when the lock cylinder is locked. When two objects are hooked together by the conventional padlock, a certain key needs to be inserted to release the objects. It is inconvenient to hook objects temporarily by the conventional padlock.

To overcome the shortcomings, the present invention provides a padlock to mitigate or obviate the aforementioned problems.

SUMMARY OF THE INVENTION

The main objective of the present invention is to provide a padlock that is easily used. The padlock has a shell, a lock cylinder, a shackle and a resilient element. The lock cylinder is mounted in the shell and has a lock rod. The shackle is mounted slidably through a front opening of the shell and has a distal end, a proximal end and a protruding segment. The distal end is selectively received in a mounting slot of the shell. The protruding segment selectively abuts the lock rod to keep the shackle from sliding. The resilient element is mounted in the shell and presses against the proximal end of the shackle. With the resilient element, the distal end of the shackle is maintained in the mounting slot without any external force. Therefore, the padlock may still hold an object in position without locking and then the user may take the object easily without using a key.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
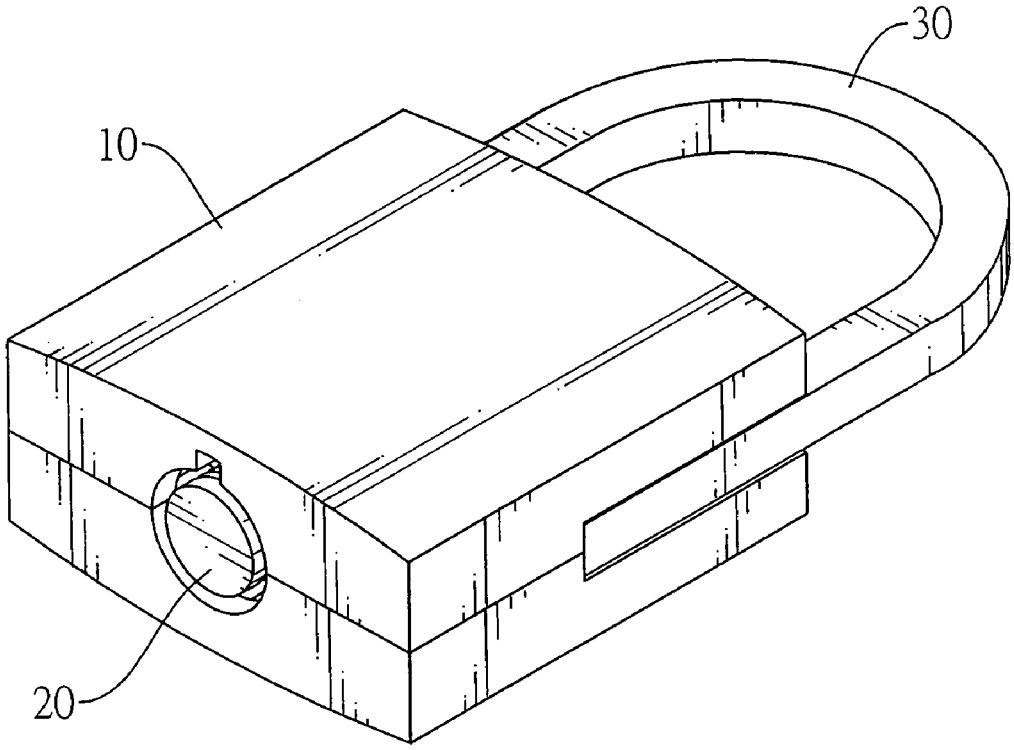
FIG. 1 is a perspective view of a padlock in accordance with the present invention.

With reference to FIG. 1, a padlock in accordance with the present invention comprises a shell (10), a lock cylinder (20), a shackle (30) and a resilient element (33).

The shell (10) is hollow and has a front end, a rear end, an inner surface, an outer sidewall, a first room (11), a second room (12), a partition (13), a front opening (14), a mounting cavity (15), a mounting slot (16) and a protrusion (17). The first room (11) is formed in the shell (10) adjacent to the front end. The second room (12) is formed in the shell (10) adjacent to the first room (11). The partition (13) is formed in the shell (10) between the first and second rooms (11, 12). The front opening (14) is formed through the front end and communicates with the first room (11). The mounting cavity (15) is formed in shell (10) through the rear end and communicates with and is adjacent to the second room (12). The mounting slot (16) is formed through the outer sidewall and is adjacent to the front end. The protrusion (17) is formed on the inner surface and extends into the mounting cavity (15).

Figure 2:
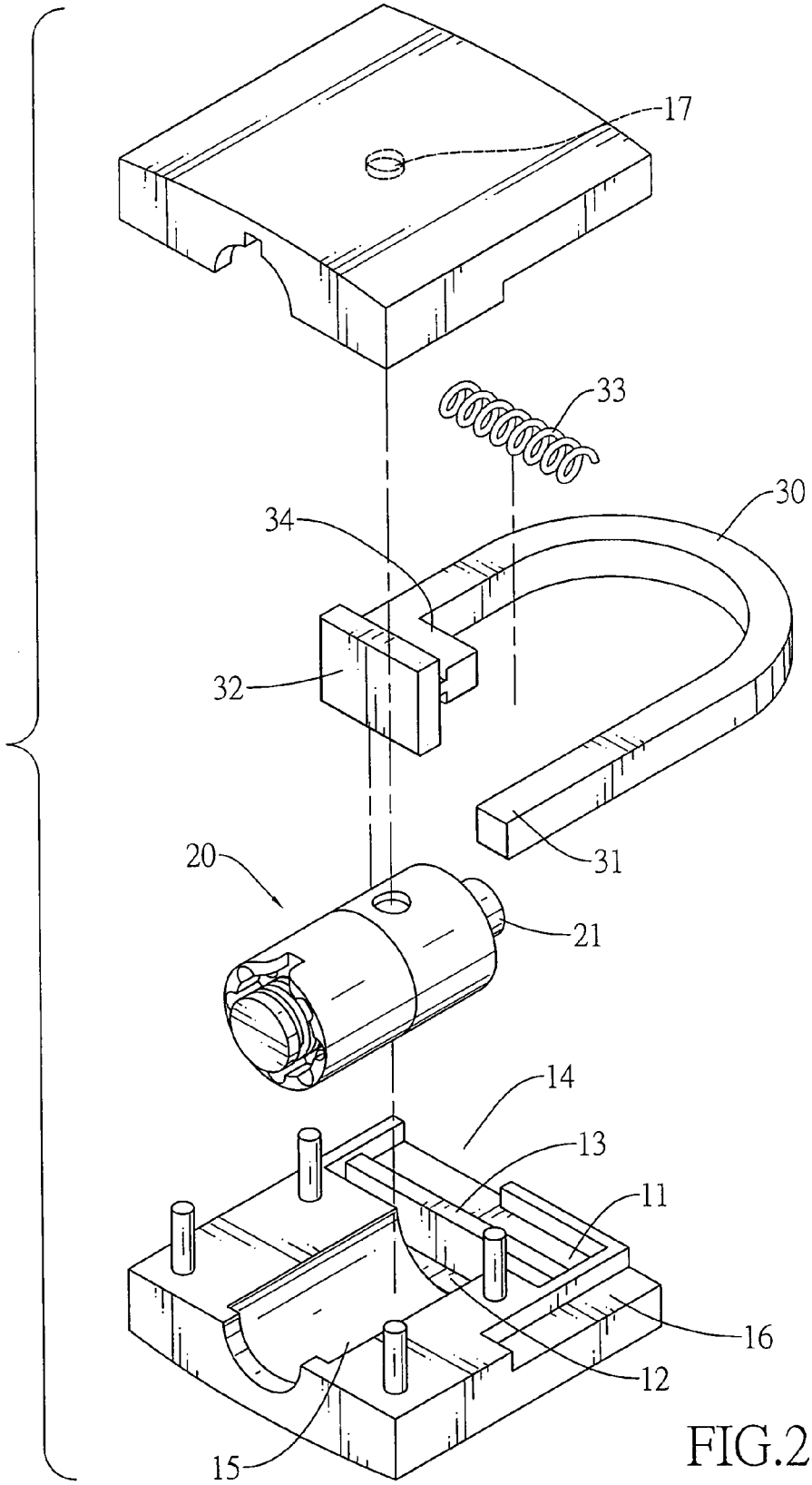
FIG. 2 is an exploded perspective view of the padlock in FIG. 1.
Figure 3:
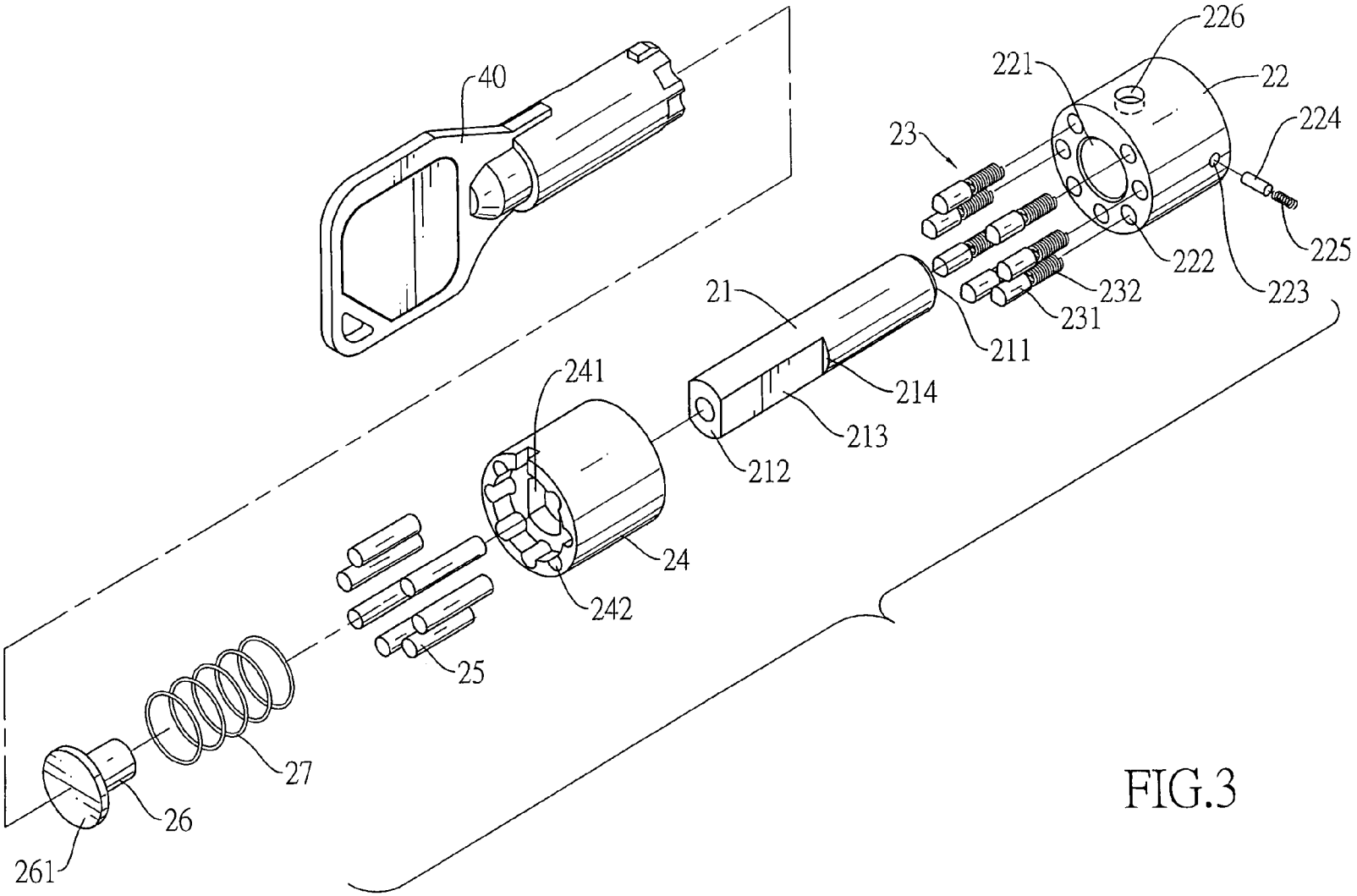
FIG. 3 is an exploded perspective view of the lock cylinder of the padlock in FIG. 1 with a key.

With reference to FIGS. 2 and 3, the lock cylinder (20) is mounted through the rear end of the shell (10), is mounted in the mounting cavity (15) of the shell (10) and has a lock rod (21) and a locking assembly.

The lock rod (21) is mounted through the rear end of the shell (10), is mounted in the mounting cavity (15) and has a front end (211), a rear end (212), a sidewall, two flat surfaces (213) and two shoulders (214). The front end (211) of the lock rod (21) selectively protrudes into the second room (12) of the shell (10). The rear end (212) of the lock rod (21) selectively protrudes out of the rear end of the shell (10). The flat surfaces (213) are formed oppositely on the sidewall of the lock rod (21). Each flat surface (213) has a first end and a second end. The first end of the flat surface (213) is adjacent to the rear end of the lock rod (21). Each shoulder (214) is formed between the sidewall and the second end of the corresponding flat surface (213).

The locking assembly is mounted in the mounting cavity (15) of the shell (10) and selectively holds the lock rod (21) to protrude in the second room (12) of the shell (10). The locking assembly may be a combination lock, tumbler lock, or the like. In the preferred embodiment, the locking assembly may have a front sleeve (22), a front locking pin assembly (23), a rear sleeve (24), multiple rear locking pins (25), a cover (26) and a main spring (27).

The front sleeve (22) is mounted securely in the mounting cavity (15) of the shell (10) and is mounted around the lock rod (21). The front sleeve (22) has a central hole (221), a rear end, a sidewall, multiple mounting recesses (222), a receiving hole (223), an actuating pin (224), a resilient element (225) and a notch (226). The central hole (221) is mounted around the lock rod (21). The mounting recesses (222) are formed longitudinally in the rear end of the front sleeve (22) around the central hole (221). The receiving hole (223) is formed transversely through the sidewall of the front sleeve (22) and communicates with the central hole (221) of the front sleeve (22). The actuating pin (224) is mounted in the receiving hole (223) of the front sleeve (22), selectively abuts a flat surface (213) of the lock rod (21) and selectively abuts a shoulder (214) of the lock rod (21). The resilient element (225) is mounted in the receiving hole (223) of the front sleeve (22) and presses against the actuating pin (224). The notch (226) is formed in the sidewall of the front sleeve (22) and is mounted around the protrusion (17) of the shell (10) to mount the front sleeve (22) securely in the mounting cavity (15) of the shell (10).

The front locking pin assembly (23) is mounted respectively in the mounting recesses (222) of the front sleeve (22) and has multiple front locking pins (231) and multiple pin springs (232). The front locking pins (231) are mounted respectively in the mounting recesses (222) of the front sleeve (22) and selectively protrude out of the rear end of the front sleeve (22). The pin springs (232) are mounted respectively in the mounting recesses (222) of the front sleeve (22) and press against the front locking pins (231).

The rear sleeve (24) is mounted rotatably in the mounting cavity (15) of the shell (10), is mounted securely around the lock rod (21) and has a central keyhole (241) and multiple through holes (242). The central keyhole (241) engages the lock rod (21) and has two flat surfaces corresponding to the flat surfaces (213) of the lock rod (21). The through holes (242) are formed longitudinally through the rear sleeve (24) around the central keyhole (241), respectively align with the mounting recesses (222) of the front sleeve (22) and are mounted respectively around the front locking pins (231).

The rear locking pins (25) are mounted respectively in the through holes (242) of the rear sleeve (24) and respectively abut the front locking pins (231).

The cover (26) is attached securely to the rear end (212) of the lock rod (21) and has an enlarged head (261).

The main spring (27) is mounted around the lock rod (21) and presses against the enlarged head (261) of the cover (26) and the rear sleeve (24).

When the locking assembly is locked, each front locking pin (231) is pressed by the corresponding pin spring (232) to protrude into the corresponding through hole (242) in the rear sleeve (24) to keep the rear sleeve (24) from rotating. When the lock rod (21) is pushed into the second room (12) of the shell (10), the actuating pin (224) moves along the sidewall of the lock rod (21) and abuts the shoulder (214) of the lock rod (21) to keep the lock rod (21) from leaving the second room (12) of the shell (10).

When a certain key (40) is inserted to unlock the locking assembly, the rear locking pins (25) are pushed to press the front locking pins (231) to fully retract into the front sleeve (22). Then the rear sleeve (24) is allowed to rotate relative to the front sleeve (22). The lock rod (21) is rotated relative to the actuating pin (224) to keep the shoulder (214) from abutting the actuating pin (224). Therefore, the lock rod (21) is free to axially move relative to the front and rear sleeves (22, 24). Then the main spring (27) presses the cover (26) to pull the lock rod (21) to leave the second room (12) of the shell (10).

Figure 6:
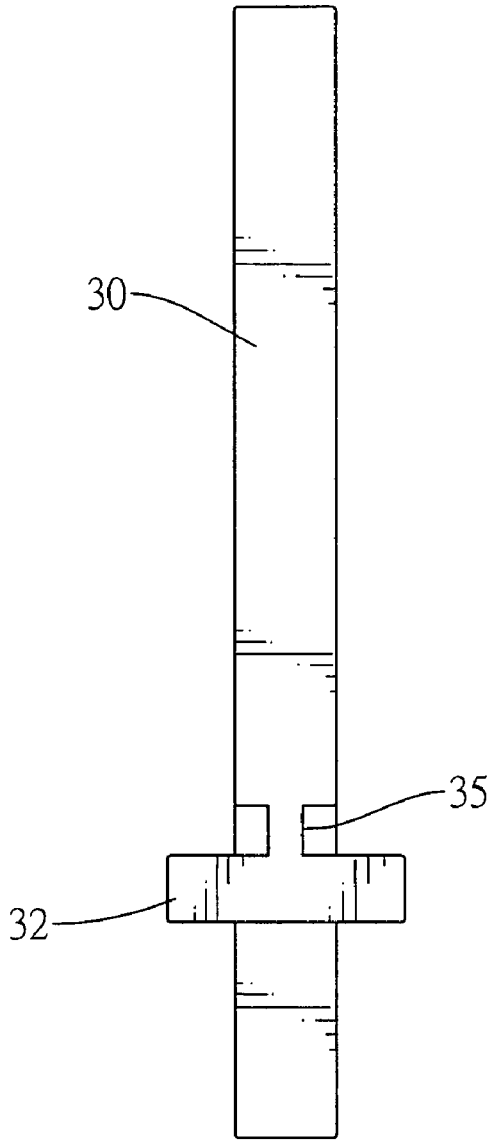
FIG. 6 is an end view of the bolt of the padlock in FIG. 1.

With reference to FIGS. 2 and 6, the shackle (30) is mounted in the front end of the shell (10), is U-shaped and has a distal end (31), a proximal end, a protruding segment (32), a pressing segment (34) and two guiding channels (35). The distal end (31) is selectively received in the mounting slot (16) of the shell (10). The proximal end is mounted movably through the front opening (14) and has a sidewall and a measure of cross-sectional area. The protruding segment (32) is formed on the proximal end of the shackle (30), is mounted slidably in the second room (12) of the shell (10), selectively abuts the lock rod (21) and has a measure of cross-sectional area. The measure of cross-sectional area of the protruding segment (32) is larger than the measure of cross-sectional area of the proximal end of the shackle (30). The pressing segment (34) is formed on the sidewall of the proximal end of the shackle (30). The guiding channels (35) are formed oppositely in the sidewall of the proximal end of the shackle (30) and are mounted slidably around the partition (13) of the shell (10).

The resilient element (33) is mounted in the first room (11) of the shell (10), presses against the proximal end of the shackle (30) and may press against the pressing segment (34).

Figure 4:
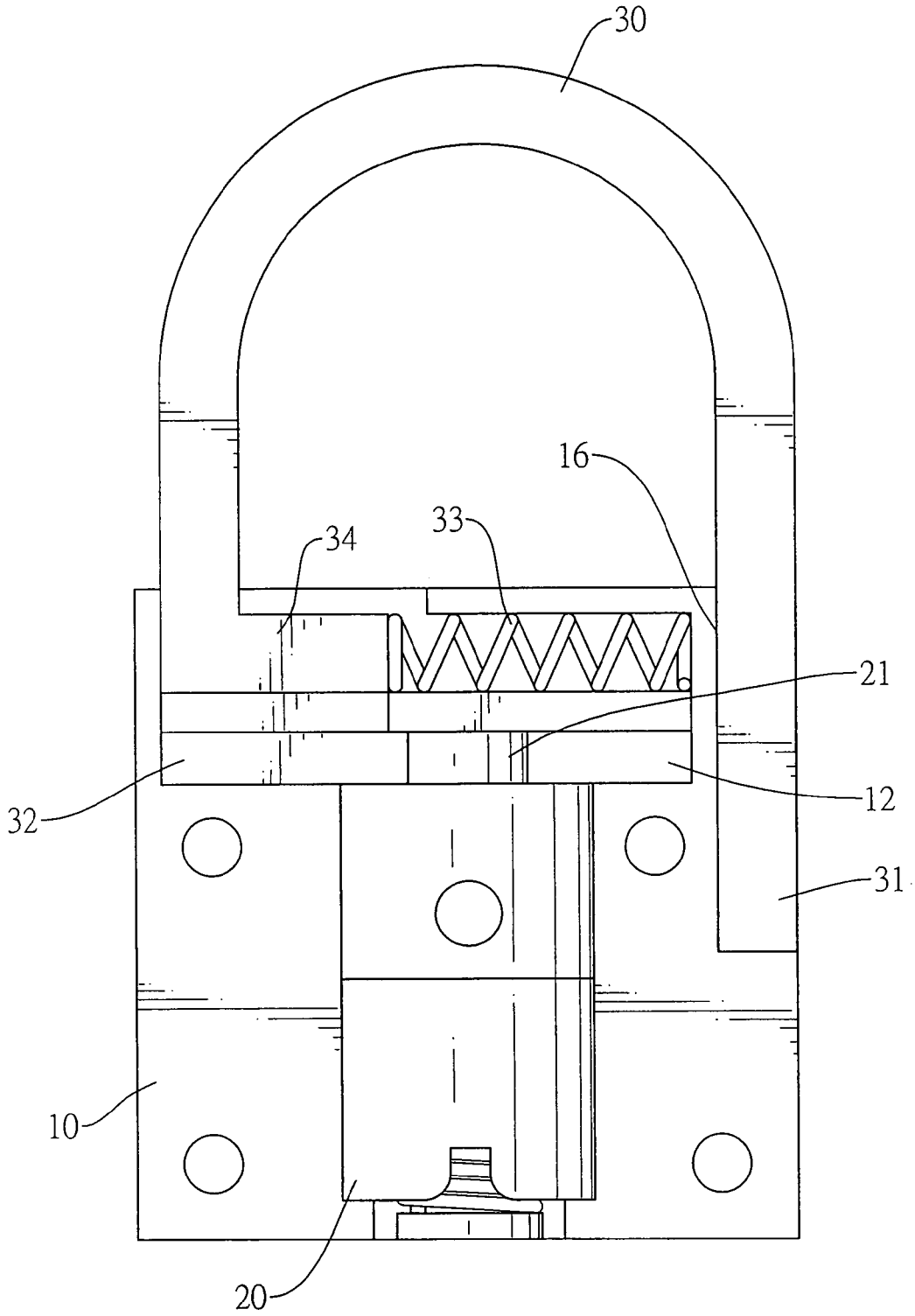
FIG. 4 is a partially side view of the padlock in FIG. 1.

With reference to FIG. 4, when the lock cylinder (20) is locked, the lock rod (21) is maintained in the second room (12) of the shell (10). The lock rod (21) abuts the protruding segment (32) of the shackle (30) to keep the shackle (30) from moving. Therefore, the distal end (31) of the shackle (30) is kept in the mounting slot (16) to lock an object.

Figure 5:
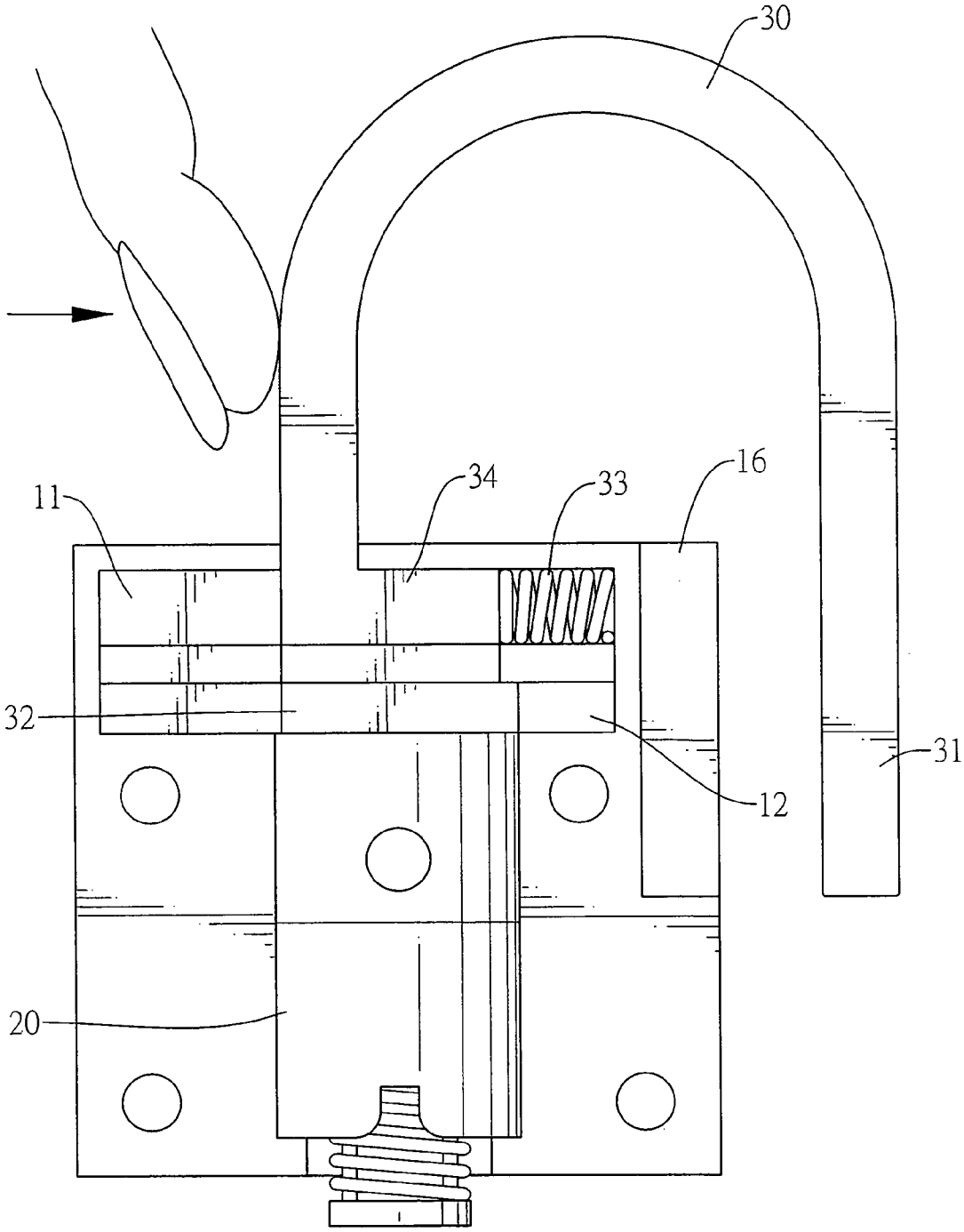
FIG. 5 is an operational partially side view of the padlock in FIG. 1.

With reference to FIGS. 3 and 5, when the lock cylinder (20) is unlocked, the lock rod (21) leaves the second room (12) of the shell (10). Then the protruding segment (32) is allowed to slide in the second room (12). The user may push the shackle (30) to slide the distal end (31) of the shackle (30) out of the mounting slot (16). Therefore, the object may be unlocked.

The padlock as described has a following advantage. Because the resilient element (33) abuts the proximal end of the shackle (30), the distal end (31) is maintained in the mounting slot (16) of the shell (10) without any other external force. Therefore, the user may temporally lock an object in place without locking the padlock as described, and may also easily unlock the object by pushing the shackle (30) without using a certain key.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A padlock comprising:

a shell being hollow and having
- a front end;
- a rear end;
- an inner surface;
- an outer sidewall;
- a first room being formed in the shell adjacent to the front end;
- a second room being formed in the shell adjacent to the first room;
- a front opening being formed through the front end and communicating with the first room;
- a mounting cavity being formed in the shell through the rear end and communicating with and being adjacent to the second room; and
- a mounting slot being formed through the outer sidewall and being adjacent to the front end;

a lock cylinder being mounted through the rear end of the shell, being mounted in the mounting cavity of the shell and having
- a lock rod being mounted through the rear end of the shell, being mounted in the mounting cavity and having
  - a front end selectively protruding into the second room of the shell;
  - a rear end selectively protruding out of the rear end of the shell; and
  - a sidewall; and
- a locking assembly being mounted in the mounting cavity of the shell and selectively holding the lock rod to protrude in the second room of the shell;

a shackle being mounted in the front end of the shell, being U-shaped and having
- a distal end being selectively received in the mounting slot of the shell;
- a proximal end being mounted movably through the front opening of the shell and having a sidewall and a measure of cross-sectional area; and
- a protruding segment being formed on the proximal end of the shackle, being mounted slidably in the second room of the shell, selectively abutting the lock rod and having a measure of cross-sectional area being larger than the measure of cross-sectional area of the proximal end of the shackle; and a resilient element being mounted in the first room of the shell and pressing against the proximal end of the shackle.

2. The padlock as claimed in claim 1, wherein the shell has a partition being formed in the shell between the first and second rooms; and the shackle has two guiding channels being formed oppositely in the sidewall of the proximal end of the shackle and being mounted slidably around the partition of the shell.

3. The padlock as claimed in claim 1, wherein the shackle has a pressing segment being formed on the sidewall of the proximal end of the shackle and pressing against the resilient element.

4. The padlock as claimed in claim 2, wherein the shackle has a pressing segment being formed on the sidewall of the proximal end of the shackle and pressing against the resilient element.

5. The padlock as claimed in claim 1, wherein the locking assembly of the lock cylinder has a front sleeve being mounted securely in the mounting cavity of the shell, being mounted around the lock rod and having a central hole being mounted around the lock rod;

a rear end;

a sidewall;

multiple mounting recesses being formed longitudinally in the rear end of the front sleeve around the central hole;

a receiving hole being formed transversely through the sidewall of the front sleeve and communicating with the central hole of the front sleeve;

an actuating pin being mounted in the receiving hole of the front sleeve, selectively abutting the lock rod; and a resilient element being mounted in the receiving hole of the front sleeve and pressing against the actuating pin;

a front locking pin assembly being mounted respectively in the mounting recesses of the front sleeve and having multiple front locking pins being mounted respectively in the mounting recesses of the front sleeve and selectively protruding out of the rear end of the front sleeve; and multiple pin springs being mounted respectively in the mounting recesses of the front sleeve and pressing against the front locking pins;

a rear sleeve being mounted rotatably in the mounting cavity of the shell, being mounted securely around the lock rod and having a central keyhole engaging the lock rod; and multiple through holes being formed longitudinally through the rear sleeve around the central keyhole, respectively aligning with the mounting recesses of the front sleeve and being mounted respectively around the front locking pins;

multiple rear locking pins being mounted respectively in the through holes of the rear sleeve and respectively abutting the front locking pins;

a cover being attached securely to the rear end of the lock rod and having an enlarged head; and a main spring being mounted around the lock rod and pressing against the enlarged head of the cover and the rear sleeve.

6. The padlock as claimed in claim 4, wherein the locking assembly of the lock cylinder has a front sleeve being mounted securely in the mounting cavity of the shell, being mounted around the lock rod and having a central hole being mounted around the lock rod;

a rear end;

a sidewall;

multiple mounting recesses being formed longitudinally in the rear end of the front sleeve around the central hole;

a receiving hole being formed transversely through the sidewall of the front sleeve and communicating with the central hole of the front sleeve;

an actuating pin being mounted in the receiving hole of the front sleeve, selectively abutting the lock rod; and a resilient element being mounted in the receiving hole of the front sleeve and pressing against the actuating pin;

a front locking pin assembly being mounted respectively in the mounting recesses of the front sleeve and having multiple front locking pins being mounted respectively in the mounting recesses of the front sleeve and selectively protruding out of the rear end of the front sleeve; and multiple pin springs being mounted respectively in the mounting recesses of the front sleeve and pressing against the front locking pins;

a rear sleeve being mounted rotatably in the mounting cavity of the shell, being mounted securely around the lock rod and having a central keyhole engaging the lock rod; and multiple through holes being formed longitudinally through the rear sleeve around the central keyhole, respectively aligning with the mounting recesses of the front sleeve and being mounted respectively around the front locking pins;

multiple rear locking pins being mounted respectively in the through holes of the rear sleeve and respectively abutting the front locking pins;

a cover being attached securely to the rear end of the lock rod and having an enlarged head; and a main spring being mounted around the lock rod and pressing against the enlarged head of the cover and the rear sleeve.

7. The padlock as claimed in claim 5, wherein the lock rod has two flat surfaces being formed oppositely on the sidewall of the lock rod, and each flat surface having a first end being adjacent to the rear end of the lock rod; and a second end; and two shoulders, and each shoulder being formed between the sidewall and the second end of a corresponding flat surface of the lock rod; and the actuating pin of the front sleeve selectively abuts a flat surface of the lock rod and selectively abuts a shoulder of the lock rod.

8. The padlock as claimed in claim 6, wherein the lock rod has two flat surfaces being formed oppositely on the sidewall of the lock rod, and each flat surface having a first end being adjacent to the rear end of the lock rod; and a second end; and two shoulders, and each shoulder being formed between the sidewall and the second end of a corresponding flat surface of the lock rod; and the actuating pin of the front sleeve selectively abuts a flat surface of the lock rod and selectively abuts a shoulder of the lock rod.

9. The padlock as claimed in claim 7, wherein the central keyhole of the rear sleeve has two flat surfaces corresponding to the flat surfaces of the lock rod.

10. The padlock as claimed in claim 8, wherein the central keyhole of the rear sleeve has two flat surfaces corresponding to the flat surfaces of the lock rod.

11. The padlock as claimed in claim 5, wherein the shell has a protrusion being formed on the inner surface and extending into the mounting cavity; and the front sleeve of the locking assembly has a notch being formed in the sidewall of the front sleeve and being mounted around the protrusion of the shell.

12. The padlock as claimed in claim 10, wherein the shell has a protrusion being formed on the inner surface and extending into the mounting cavity; and the front sleeve of the locking assembly has a notch being formed in the sidewall of the front sleeve and being mounted around the protrusion of the shell.

* * * * *